US009865970B2

(12) United States Patent
Abe et al.

(10) Patent No.: US 9,865,970 B2
(45) Date of Patent: Jan. 9, 2018

(54) CONNECTOR AND MANUFACTURING METHOD OF CONNECTOR

(71) Applicant: YAZAKI CORPORATION, Tokyo (JP)

(72) Inventors: Shintaro Abe, Shizuoka (JP); Isao Kameyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/173,026

(22) Filed: Jun. 3, 2016

(65) Prior Publication Data

US 2016/0365674 A1 Dec. 15, 2016

(30) Foreign Application Priority Data

Jun. 12, 2015 (JP) ..... 2015-119470

(51) Int. Cl.

| | |
|---|---|
| ***H01R 9/05*** | (2006.01) |
| ***H01R 13/6477*** | (2011.01) |
| ***H01R 13/11*** | (2006.01) |
| ***H01R 13/436*** | (2006.01) |
| ***H01R 13/6581*** | (2011.01) |
| ***H01R 43/05*** | (2006.01) |
| ***H01R 43/18*** | (2006.01) |
| ***H01R 4/18*** | (2006.01) |
| *H01R 9/03* | (2006.01) |

(Continued)

(52) U.S. Cl.

CPC ..... *H01R 13/6477* (2013.01); *H01R 4/185* (2013.01); *H01R 13/111* (2013.01); *H01R 13/4362* (2013.01); *H01R 13/6581* (2013.01); *H01R 43/05* (2013.01); *H01R 43/18* (2013.01); *H01R 9/035* (2013.01); *H01R 13/6463* (2013.01); *H01R 13/658* (2013.01)

(58) Field of Classification Search

USPC ..... 439/579, 701, 607.48, 607.5, 607.51

See application file for complete search history.

(56) References Cited

U.S. PATENT DOCUMENTS 3,587,028 A * 6/1971 Uberbacher ..... H01R 13/506 439/49
5,190,472 A * 3/1993 Voltz ..... H01R 13/6589 439/579

(Continued)

FOREIGN PATENT DOCUMENTS

JP 9-161895 A 6/1997
JP 2001-283999 A 10/2001

(Continued)

OTHER PUBLICATIONS

Japanese Office Action for the related Japanese Patent Application No. 2015-119470 dated Apr. 11, 2017.

*Primary Examiner* — Tho D Ta
(74) *Attorney, Agent, or Firm* — Kenealy Vaidya LLP

(57) ABSTRACT

A connector includes a housing unit which accommodates terminals which are crimped onto respective ends of a plurality of electric wires. The housing unit includes housings of a number corresponding to a number of the terminals, each of the housings configured to accommodate each of the terminals. At least one of the housings is formed by a material which has a dielectric constant at which impedance between each of the terminals is a desired impedance.

8 Claims, 9 Drawing Sheets

(51) Int. Cl.
*H01R 13/658* (2011.01)
*H01R 13/6463* (2011.01)

(56) References Cited

U.S. PATENT DOCUMENTS 5,330,371 A * 7/1994 Andrews ..... H01R 13/65802 439/579
5,466,175 A * 11/1995 Onoda ..... H01R 9/0518 439/607.48
5,683,269 A * 11/1997 Davis ..... H01R 13/6593 439/607.5
7,195,518 B2 * 3/2007 Bert ..... H01R 4/2441 439/290
7,384,306 B2 * 6/2008 Malstrom ..... H01R 24/50 439/394
7,909,646 B2 * 3/2011 Feldman ..... H01R 9/0512 439/108
7,909,647 B2 * 3/2011 Kawaguchi ..... H01R 9/035 439/585
8,801,469 B2 * 8/2014 Wu ..... H01R 13/6477 439/607.01
8,840,435 B2 * 9/2014 Plazio ..... H01R 13/506 439/607.41
2009/0221190 A1 9/2009 Ambo et al.
2013/0023154 A1 * 1/2013 Ii ..... H01R 9/038 439/607.5
2013/0288523 A1 * 10/2013 Ii ..... H01R 13/658 439/607.01
2015/0303601 A1 * 10/2015 Jeon ..... H01R 12/716 439/65

FOREIGN PATENT DOCUMENTS

JP 2003-173828 A 6/2003
JP 2009-64690 A 3/2009
JP 2011-134571 A 7/2011
JP 2014-229376 A 12/2014
WO 2006/132195 A1 12/2006

* cited by examiner

CONNECTOR AND MANUFACTURING METHOD OF CONNECTOR

CROSS REFERENCE TO RELATED APPLICATION

This application is based on Japanese Patent Application (No. 2015-119470) filed on Jun. 12, 2015, the contents of which are incorporated herein by reference. Also, all the references cited herein are incorporated as a whole.

BACKGROUND OF THE INVENTION

1. Technical Field

The present invention relates to a connector and a manufacturing method of a connector which are used in a connection of a cable.

2. Background Art

In the related art, for example, a technique is known as exemplified in FIG. 1 of Patent Document 1 as a technique for matching impedance of a connector with impedance of shielded cables connected to each other in order to prevent signal transmission loss or prevent generation of noise when the shielded cables are connected to each other.

The connector which is exemplified in FIG. 1 of Patent Document 1, by attaching an adapter 24 which has conductivity to the outer periphery of a conductive body 22 as necessary, causes impedance of the connector to be adjusted by changing a cross-section ratio of a terminal 21 and an outer conductor shell 23.

In addition to the technique disclosed in Patent Document 1, for example, a technique which is disclosed in Patent Document 2 is known as a technique for adjusting impedance of a connector.

As exemplified in FIG. 9, a shielded connector which is disclosed in Patent Document 2 is configured to be provided with a shielded cable 110, a terminal 120, an inner housing 130, and an outer conductor shell 140.

The shielded cable 110 is formed by covering a signal line 111 which is formed by sheathing the outer side of a conductor 111a with an insulation sheathing layer 111b and a drain line 112 which is formed by intertwining a plurality of copper element wires using a metal foil 113, and covering the outer side of the metal foil 113 with an insulation outer sheath 114.

The inner housing 130 is formed using synthetic resin, and is formed with a terminal accommodating chamber 131 which is capable of accommodating the terminal 120 thereinside.

The outer conductor shell 140 is formed by sheet-metal working a metal plate which has conductivity, and is formed in a shape which is mountable to the outside of the inner housing 130.

Patent Document 1 is JP-A-2001-283999, and Patent Document 2 is JP-A-2003-173828.

SUMMARY OF THE INVENTION

In techniques of the related art, it is known that signal transmission loss, noise generation, or crosstalk generation may occur between terminals of a connector, and matching of impedance between the terminals is performed as a countermeasure.

Matching of impedance between the terminals of the connector is performed by adjusting an interval between terminals and a dielectric constant of a housing of the connector. Here, in a case where the shape of the connector is determined according to the type or application of the connector, and the interval between terminals is decided, it is necessary to match the impedance between the terminals by modifying a material of the housing to a material which has a dielectric constant where impedance between the terminals is a desired impedance.

However, when a housing is formed using different materials in each connector, there is a problem in that manufacturing costs of the connector increase. Due to such a problem, there is a problem in that it is not possible to easily perform matching of impedance between terminals in the techniques in the related art.

Furthermore, the techniques in the related art have the following problems.

In the techniques in the related art, since a terminal is crimped onto ends of a plurality of electric wires, it is necessary to expose the plurality of electric wires by peeling an insulation outer sheath in a cable end, and unravel the intertwining of the plurality of electric wires. Here, there is a risk that a portion in which the intertwining of the plurality of electric wires is unraveled tends to receive noise influence so as to cause non-matching of impedance. For this reason, in the techniques in the related art, shortening of a length of the plurality of electric wires of which the intertwining is unraveled is performed.

However, if the length of the plurality of electric wires of which the intertwining is unraveled is shortened, when the terminal which is crimped onto respective ends of the plurality of electric wires is inserted into a terminal accommodating chamber of the housing, it is difficult to insert the electric wires onto which the terminals are crimped one at a time. For this reason, work for aligning the terminals and the electric wires, and collectively inserting all of the individual terminals into the terminal accommodating chamber of the housing is necessary. Thereby, there is a problem in that workability of assembly of the terminals to the housing worsens.

In addition, even in a case where the length of the plurality of electric wires of which the intertwining is unraveled is shortened, there is a problem in that in the portion in which the intertwining of the plurality of electric wires is unraveled, non-matching of impedance occurs, and due to this transmission characteristics deteriorate.

The present invention is carried out in consideration of the above circumstances, and an object is to provide a connector and a manufacturing method of a connector in which it is possible to easily perform matching of impedance between terminals while suppressing manufacturing costs.

Another object is to provide a connector and a manufacturing method of a connector in which workability of assembly of terminals to a housing is favorable.

According to the present invention according to Aspect 1 that is carried out in order to achieve such objects, there is provided a connector including a housing unit which accommodates terminals which are crimped onto respective ends of a plurality of electric wires, in which the housing unit includes housings of a number corresponding to a number of the terminals, each of the housings configured to accommodate each of the terminals, and at least one of the housings is formed by a material which has a dielectric constant at which impedance between each of the terminals is a desired impedance.

In the present invention which has such a characteristic, terminals are accommodated respectively in the housing unit that is divided in accordance with the number of terminals. At least one of the respective housings is formed by a material which has a dielectric constant where impedance between respective terminals is a desired impedance. Thereby, impedance between respective terminals becomes a desired impedance.

In the connector of the present invention according to Aspect 2, according to the connector according to Aspect 1, a terminal accommodating section with a concave shape along an axial direction of each housing is provided in each housing.

The present invention which has such a characteristic is provided with the terminal accommodating section which is formed in the concave shape along the axial direction of each housing in each housing. The terminal is inserted and accommodated in the terminal accommodating section from a direction orthogonal to the axial direction of the housing.

In the connector of the present invention according to Aspect 3, according to the connector according to Aspect 2, a terminal holding section which holds a terminal of the terminals to be embraced is formed in the terminal accommodating section.

In the present invention which has such a characteristic, the terminal which is accommodated in the terminal accommodating section is held so as to be embraced in the terminal holding section.

In the connector of the present invention according to Aspect 4, according to the connector according to any one of Aspects 1 to 3, an abutting section which abuts with a terminal of the terminals when the housings are fitted with each other is provided in each housing.

According to the present invention which has such a characteristic, when the housings are fitted with each other, the abutting section which is provided in the housing abuts with the terminal. Thereby, the terminal is pressed down in the abutting section in a state of being accommodated in the housing.

According to the present invention according to Aspect 5, there is provided a manufacturing method of a connector including a housing unit which accommodates terminals which are crimped onto respective ends of a plurality of electric wires, the housing unit comprising housings of a number corresponding to a number of the terminals, the method including manufacturing each of the housings configured to accommodate each of the terminals, and forming at least one of the housings by a material which has a dielectric constant at which impedance between each of the terminals is a desired impedance.

In the present invention which has such a characteristic, the terminals are accommodated respectively in the housing that is divided in accordance with the number of terminals. At least one of the respective housings is formed by a material which has a dielectric constant where impedance between respective terminals is a desired impedance. Thereby, impedance between respective terminals becomes a desired impedance.

The manufacturing method of a connector of the present invention according to Aspect 6, in the manufacturing method of a connector according to Aspect 5, further includes: unraveling intertwining of the ends of the plurality of electric wires which are provided with a configuration of intertwining the electric wires with each other and crimping each of the terminals onto each of the ends of each of the electric wires; and after the crimping, intertwining at least one pair of electric wires out of the plurality of electric wires once or twice or more in respective ends of the plurality of electric wires.

According to the present invention which has such a characteristic, out of the plurality of electric wires, at least one pair of electric wires is provided with a configuration such as of a so-called twisted pair electric wire. For this reason, a line of magnetic force which is generated in a pair of electric wires that are intertwined acts in directions offset from each other. By doing this, in the one pair of intertwined electric wires, induced electromotive forces which are generated due to electromagnetic induction cancel each other out. Thereby, in comparison to a case where the plurality of electric wires are lined up approximately parallel, electromagnetic noise is reduced due to the electromagnetic induction.

According to the present invention according to Aspect 1, it is possible to achieve matching of impedance between respective ends by forming at least one out of divided housings by a material which has a dielectric constant at which impedance between respective terminals is a desired impedance. That is, merely by changing the material of at least one housing out of the respective housings, it is possible to match impedance between respective terminals to a desired impedance. Thereby, even in a case where the shape of the connector is determined according to the type or application of the connector, and the interval between terminals is decided, it is not necessary to change the material of the entirety of the housing. For this reason, selection of the material of the housing becomes easy. Accordingly, an effect is exhibited in which it is possible to easily perform matching of impedance between the terminals while suppressing manufacturing costs of the connector.

In addition, according to the present invention, since the terminals are respectively assembled to the housing which is divided in accordance with the number of terminals, it is possible to guide and accommodate the terminal which is crimped onto respective terminals of the plurality of electric wires to an appropriate position within the housing. Thereby, even in a case where the length of the plurality of electric wires of which the intertwining is unraveled is short, it is possible to easily accommodate the plurality of terminals in the housing. For this reason, work for aligning the terminals and the electric wires, and collectively inserting all of the individual terminals into the terminal accommodating chamber of the housing is not necessary. Accordingly, an effect is exhibited in which it is possible to improve workability of assembly of the terminals to the housing.

According to the present invention according to Aspect 2, the terminals are inserted and accommodated in the terminal accommodating section from a direction orthogonal to the axial direction of the housing. Thereby, it is possible to accommodate each terminal in the housing one at a time. Thereby, even in a case where the length of which the intertwining of the plurality of electric wires is unraveled is short, it is possible to easily accommodate the plurality of terminals in the housing. Thereby, work for aligning the terminals and the electric wires, and collectively inserting all of the individual terminals into the terminal accommodating chamber of the housing is not necessary. Accordingly, an effect is exhibited in which it is possible to improve workability of assembly of the terminals to the housing.

According to the present invention according to Aspect 3, it is possible to hold the terminals in the housing merely by mounting the terminals in the terminal holding section. Accordingly, an effect is exhibited in which it is possible to easily perform work of assembly of the terminals with respect to the housing.

In addition, according to the present invention, since the terminals are held so as to be embraced in the terminal holding section, an effect is exhibited in which it is possible to reliably hold a state in which each terminal is assembled to the housing.

According to the present invention according to Aspect 4, it is possible to fix the terminals at an appropriate position within the housing by pressing down the terminal in the abutting section in a state in which the terminals are accommodated in the housing. Accordingly, an effect is exhibited in which it is possible to more reliably hold the state in which each terminal is assembled to the housing.

According to the present invention according to Aspect 5, it is possible to achieve matching of impedance between respective terminals by forming at least one out of divided housings by a material which has a dielectric constant at which impedance between respective terminals is a desired impedance. That is, merely by changing the material of at least one housing out of the respective housings, it is possible to match impedance between respective terminals to a desired impedance. Thereby, even in a case where the shape of the connector is determined according to the type or application of the connector, and the interval between terminals is decided, it is not necessary to change the material of the entirety of the housing. For this reason, selection of the material of the housing becomes easy. Accordingly, an effect is exhibited in which it is possible to easily perform matching of impedance between terminals while suppressing manufacturing costs of the connector.

In addition, according to the present invention, since the terminals are respectively assembled to the housing which is divided in accordance with the number of terminals, it is possible to guide and accommodate the terminal which is crimped onto respective terminals of the plurality of electric wires to an appropriate position within the housing. Thereby, even in a case where the length of which the intertwining of the plurality of electric wires is unraveled is short, it is possible to easily accommodate the plurality of terminals in the housing. For this reason, work for aligning the terminals and the electric wires, and collectively inserting all of the individual terminals into the terminal accommodating chamber of the housing is not necessary. Accordingly, an effect is exhibited in which it is possible to improve workability of assembly of the terminals to the housing.

According to the present invention according to Aspect 6, one pair of intertwined electric wires tends not to receive an influence of electromagnetic noise due to electromagnetic induction in comparison to a case in which a plurality of electric wires are lined up substantially parallel. Thereby, it is possible to match impedance in a portion in which the intertwining of the plurality of electric wires is unraveled. Accordingly, in an end section of the cable, an effect is exhibited in which it is possible to reduce deterioration of transmission performance in a portion in which the electric wires are exposed.

DETAILED DESCRIPTION OF THE EXEMPLARY EMBODIMENTS

Example 1 of a connector according to the present invention is described below with reference to FIGS. 1 to 7, and Example 2 of the connector according to the present invention is described with reference to FIG. 8.

Example 1

Example 1 is described below with reference to FIGS. 1 to 7.

Figure 1:
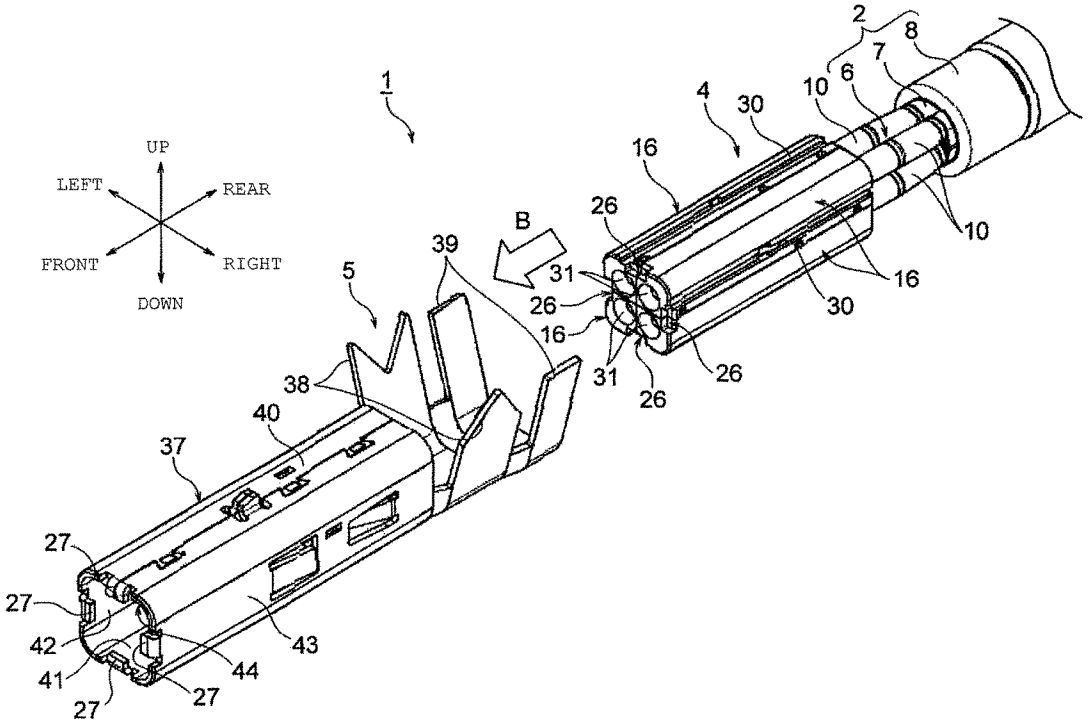
FIG. 1 is an exploded perspective view illustrating Example 1 of a connector of the present invention.
Figure 2:
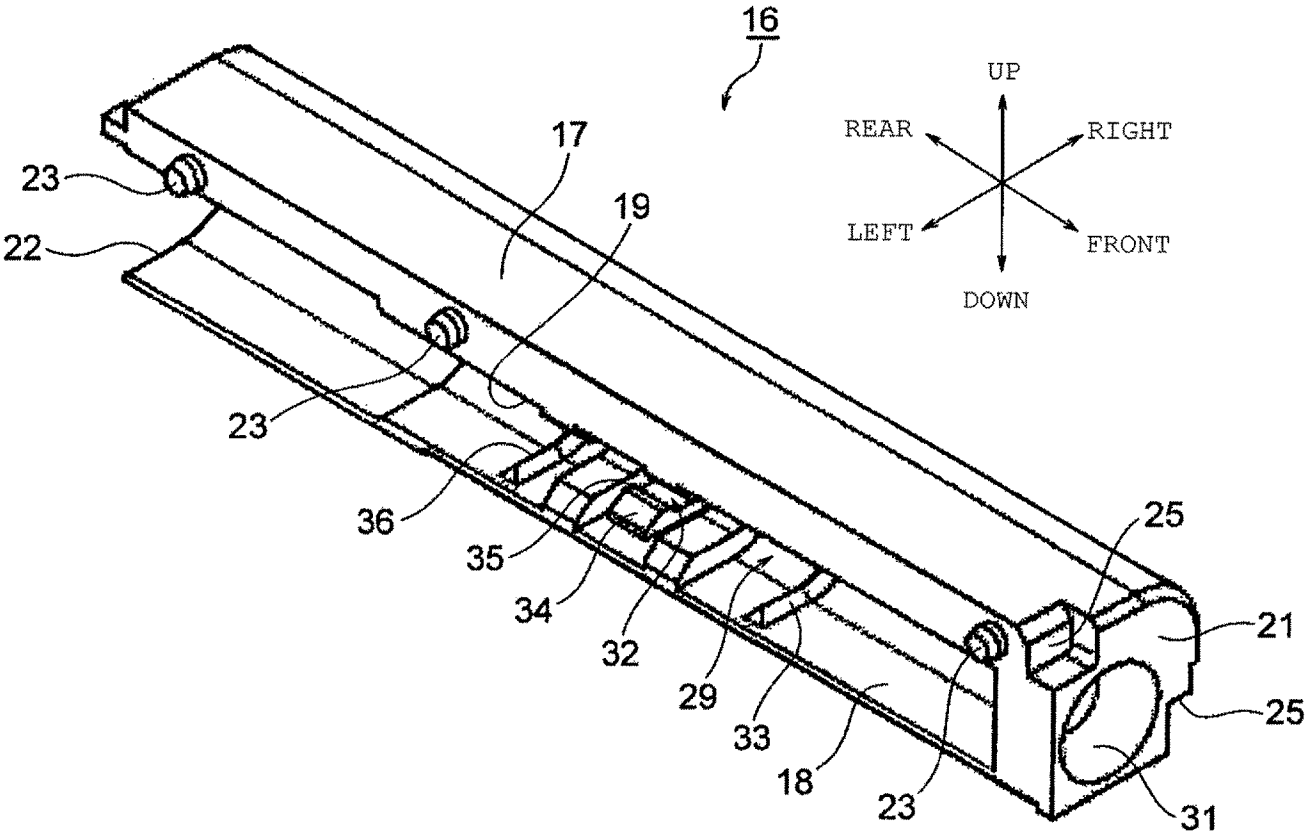
FIG. 2 is perspective view of a housing.
Figure 3A:
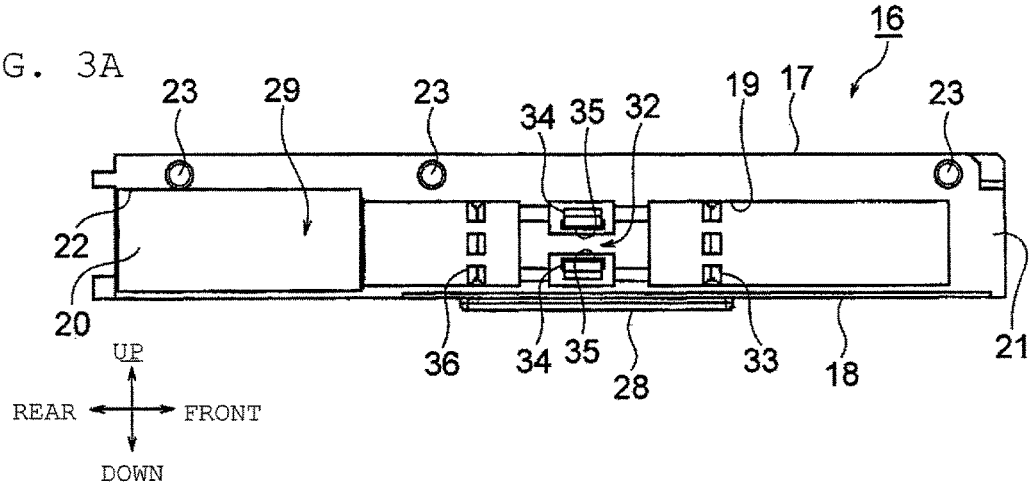
FIGS. 3A to 3*c* illustrate a side view and a bottom view of the housing.
Figure 3B:
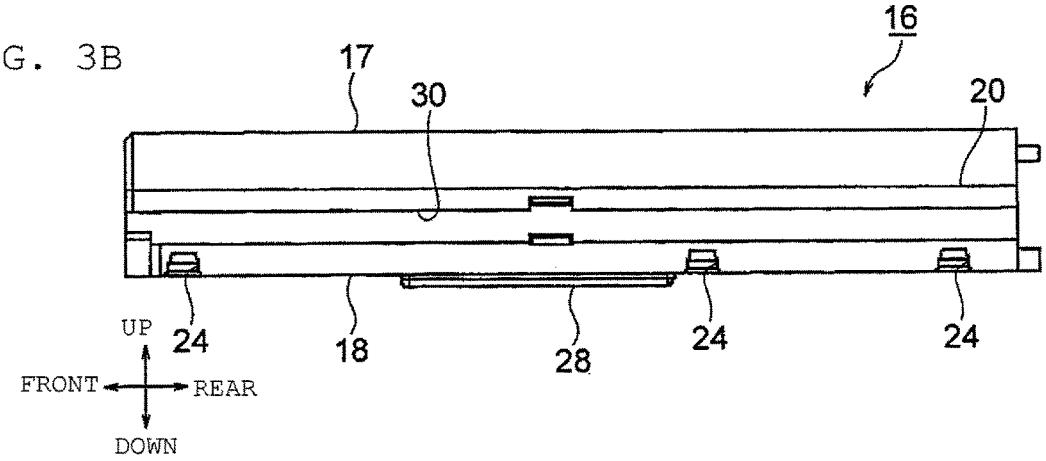
Figure 3C:
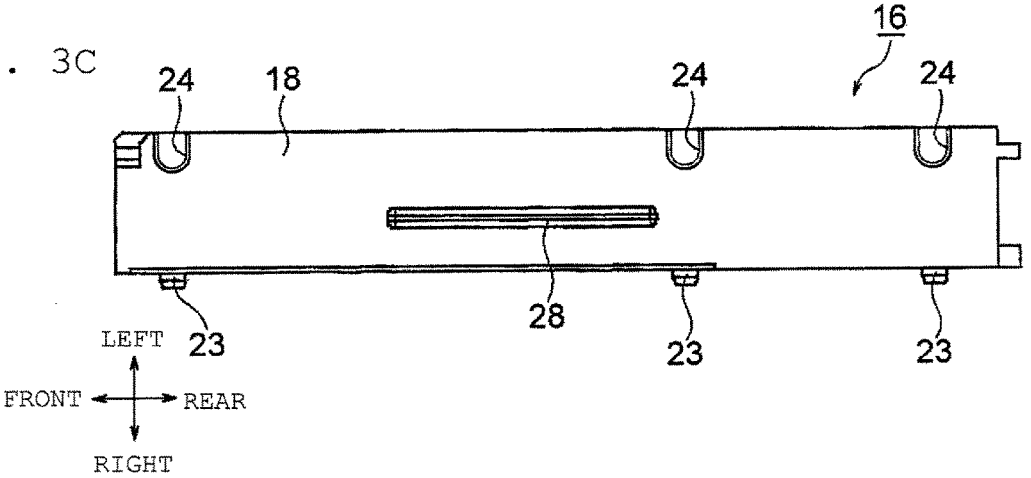
Figure 4A:
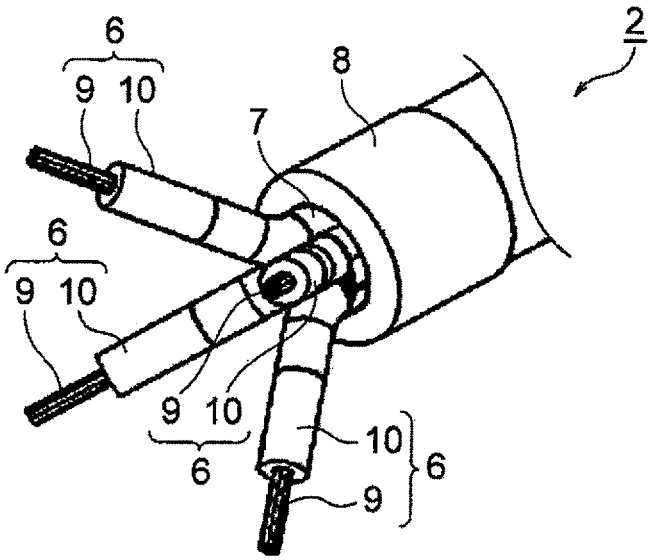
FIGS. 4A and 4B illustrate diagrams which describe a work procedure for assembling the connector.
Figure 4B:
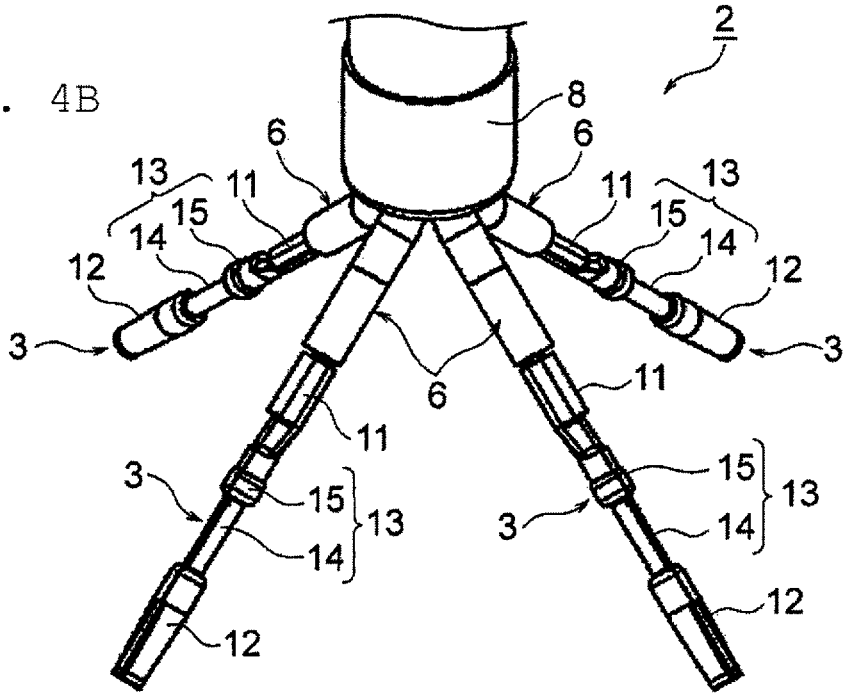
Figure 5:
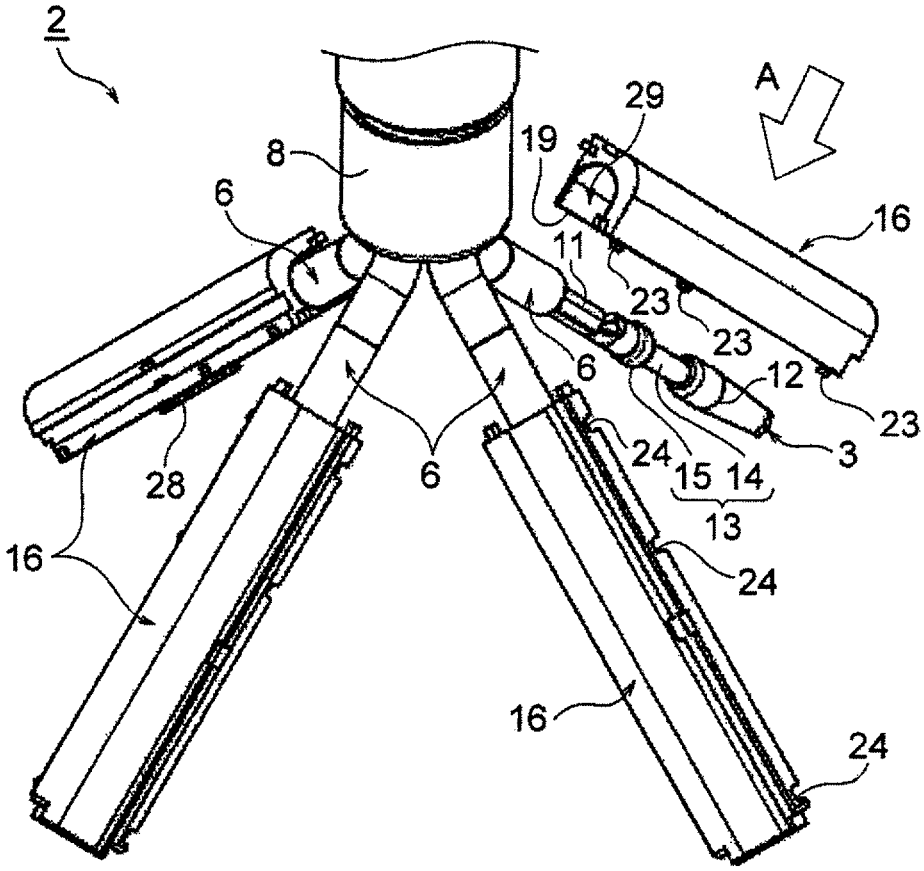
FIG. 5 is a diagram which describes a work procedure for assembling the connector.
Figure 6:
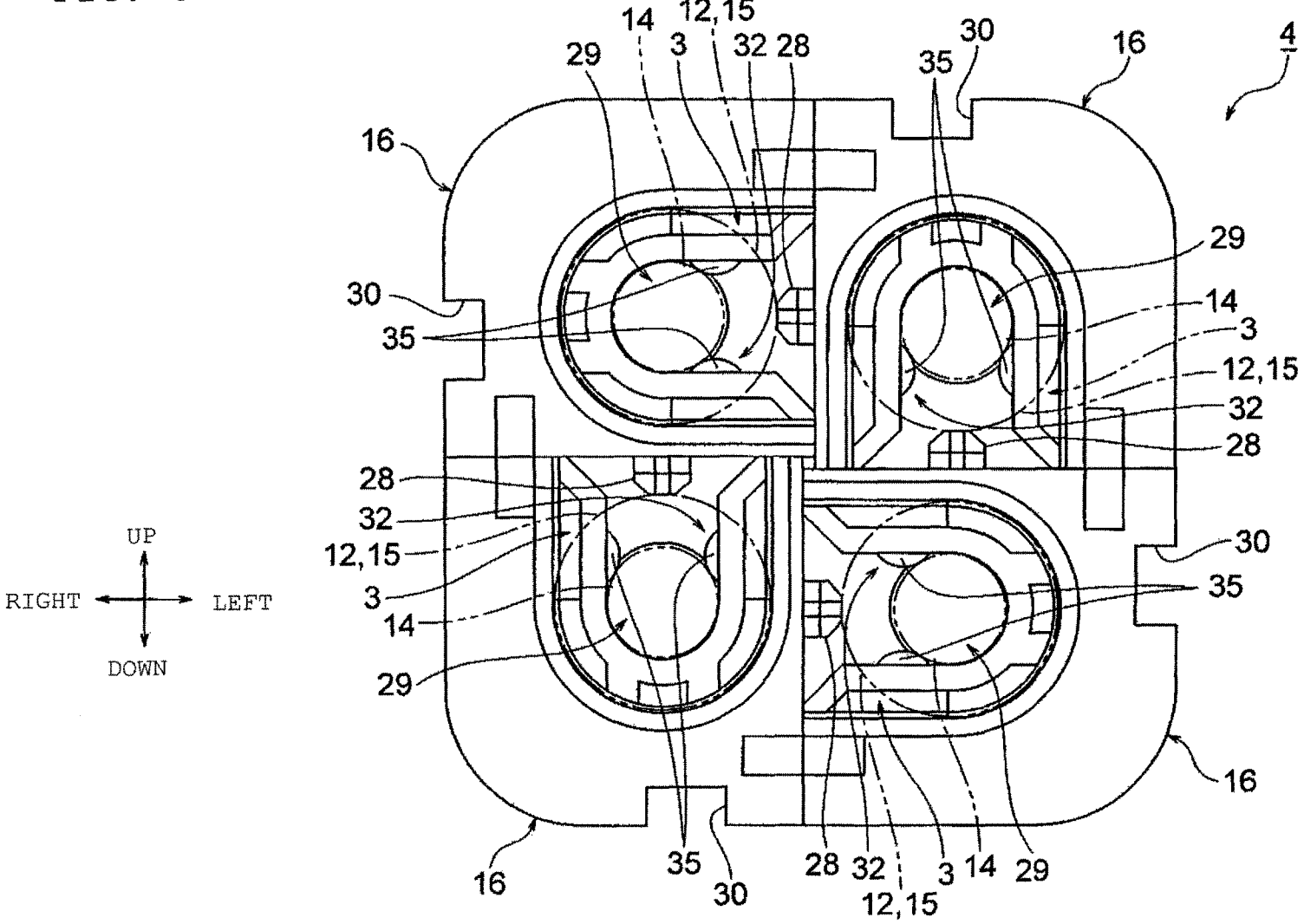
FIG. 6 is a rear surface view of a state in which a plurality of housings are fitted.
Figure 7:
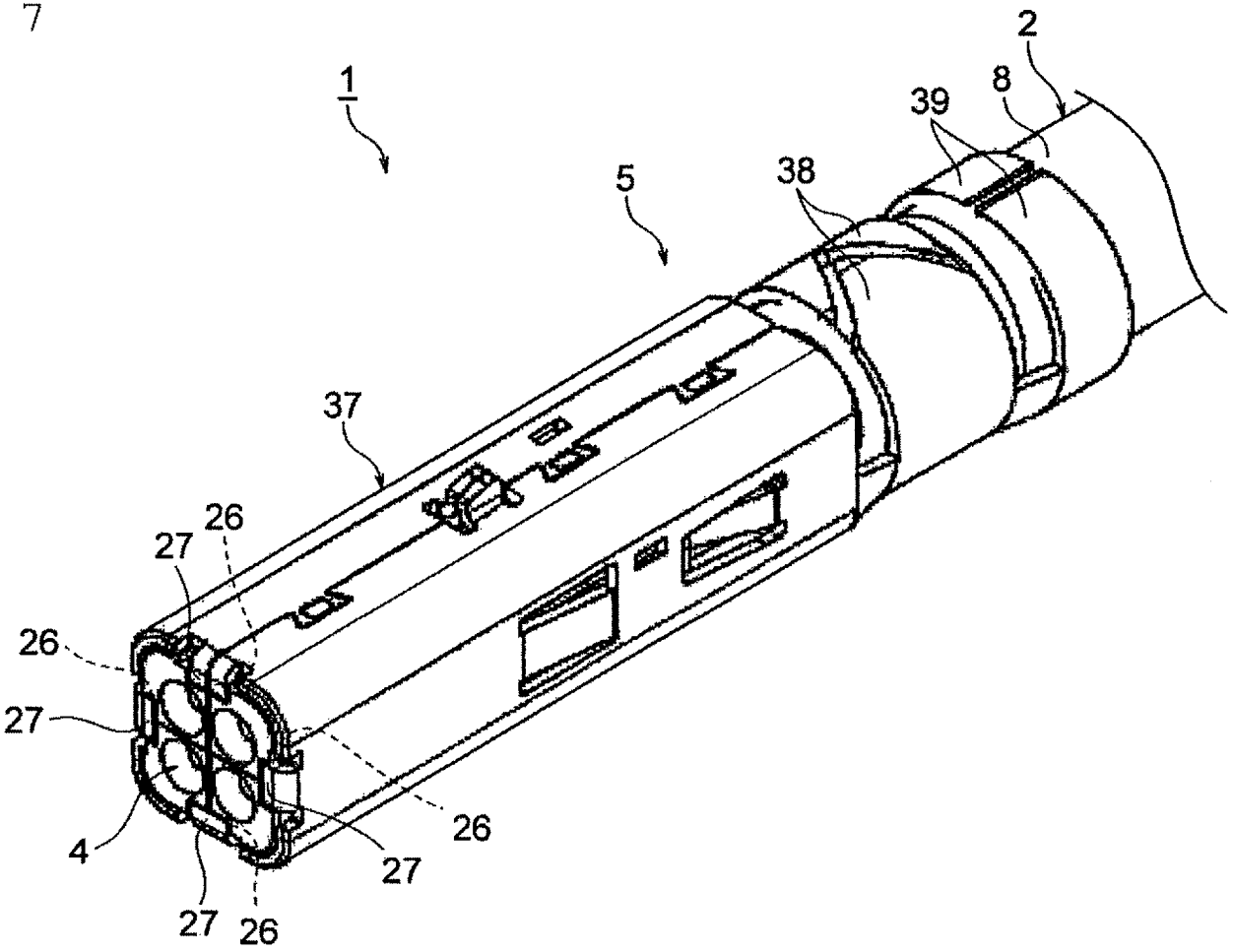
FIG. 7 is perspective view of the connector.

FIG. 1 is an exploded perspective view illustrating Example 1 of the connector of the present invention, FIG. 2 is perspective view of a housing, FIGS. 3A to 3C illustrate the housing, FIG. 3A is a left side view of the housing, FIG. 3B is a right side view of the housing, FIG. 3C is a bottom view of the housing, FIGS. 4A and 4B illustrate diagrams which describe a work procedure for assembling the connector, FIG. 4A is a perspective view of an end section of a cable, FIG. 4B is a perspective view illustrating a state in which terminals are crimped onto respective terminals of a plurality of electric wires, FIG. 5 is a diagram which describes a work procedure for assembling the connector, and is a perspective view illustrating work in which each terminal is respectively accommodated in the housing, FIG. 6 is a rear surface view of a state in which a plurality of housings are fitted, and FIG. 7 is perspective view of the connector.

Here, arrows in the drawings indicate each direction of front and rear, up and down, and left and right (each direction of the arrows is an example).

In FIG. 1, reference numeral 1 indicates Example 1 of the connector of the present invention. The connector 1 is not particularly limited, but in the present Example, is a female connector.

The connector 1 is configured to be provided with a cable 2, a terminal 3 (refer to FIG. 4B), a housing unit 4, and a shield shell 5.

Each configuration of the connector 1 is described below.

First, the cable 2 is described.

As exemplified in FIG. 1, the cable 2 is configured to be provided with a plurality (four in the present Example) of electric wires 6, a metal foil 7 which is provided on the plurality of electric wires 6, and an insulation outer sheath 8 which is sheathed and formed on the metal foil 7. In the end section, the cable 2 has the insulation outer sheath 8 and the metal foil 7 peeled away, and is formed such that a plurality of electric wires 6 are exposed.

As exemplified in FIG. 4A, the electric wires 6 are configured to be provided with a conductor 9 and an insulation sheath 10 which is sheathed on the conductor 9.

The plurality of electric wires 6 are configured to be intertwined in a portion which is sheathed by the metal foil 7 and the insulation outer sheath 8. In addition, the plurality of electric wires 6 have the insulation outer sheath 8 and metal foil 7 peeled away, and in the exposed portion, are configured such that intertwining is unraveled.

Next, the terminal 3 is described.

The terminal 3 is formed in a shape as exemplified in FIG. 4B by sheet-metal working a metal plate which has conductivity. The terminal 3 is not particularly limited, but in the present Example, is a female terminal.

As exemplified in FIG. 4B, the terminals 3 are configured to be provided with a semiconductor crimping section 11 which is crimped in the conductor 9 of the electric wire 6, an electrical connection section 12 which is electrically connected to a female end of the connector that is a connection counterpart which is formed in a cylindrical shape, and a linking section 13 which links the semiconductor crimping section 11 and the electrical connection section 12.

In the linking section 13, a small diameter section 14 which is formed in a cylindrical shape with a smaller diameter than the electrical connection section 12 is provided on the electrical connection section 12 side. In addition, in the linking section 13, a large diameter section 15 which is formed with substantially the same diameter as the electrical connection section 12 is provided on the semiconductor crimping section 11 side.

Next, the housing unit 4 is described.

The housing unit 4 is formed by synthetic resin, and as exemplified in FIG. 1, is formed in a substantial box shape. The housing unit 4 is configured to be provided with a housing 16 which is divided in accordance with the number of terminals 3. In the present Example, the housing unit 4 has a structure of being divided into four housings 16 in accordance with the number of terminals 3 (four in the present Example). The four housings 16 are configured to form the housing unit 4 by fitting the four housings 16 to each other.

Each housing 16 is formed in the same shape, and has the same configuration and structure. Accordingly, out of the respective housings 16, the configuration of one housing 16 is described below.

The housing 16 is formed by a material which has a dielectric constant in which an impedance value between the terminals 3 that are accommodated within the housing unit 4 is a desired impedance value. In the present Example, out of the four housings 16, at least one is formed by a material which has a dielectric constant in which an impedance value between the terminals 3 is a desired impedance value (the number is an example).

For example, in a case where the dielectric constant of the housing 16 is reduced and impedance between respective terminals 3 is matched, the housing 16 is formed by a material which has a low dielectric constant among the synthetic resin. Among the synthetic resin, as the material which has a low dielectric constant in comparison to another synthetic resin, for example, there is polytetrafluoroethylene (trade name: Teflon (registered trademark)) (the material is an example).

As exemplified in FIG. 2, the housing 16 is formed in a substantial trough shape. As exemplified in FIG. 2 and FIG. 3, the housing 16 is configured to be provided with an upper wall 17, a bottom wall 18, a right side wall 20, a front wall 21, a terminal insertion opening 19, an electric wire outlet 22, and a terminal accommodating section 29.

As exemplified in FIG. 2, a fitting protrusion 23 protrudes to the left side section of the upper wall 17. The fitting protrusion 23 is formed in a shape such that it is possible to fit in a fitting groove 24 which will be described later (refer to FIGS. 3B and 3C). The fitting protrusion 23 is formed as a portion for positionally aligning the fitting position when the housings 16 are fitted to each other by fitting in the fitting groove 24. In the present Example, the fitting protrusion 23 is provided in three locations of the vicinity of a front end, a substantially intermediate section, and the vicinity of the rear end of the housing 16.

In addition, as exemplified in FIG. 2, a concave section 25 is formed in a portion which links the upper wall 17 and the front wall 21. As exemplified in FIG. 1, in a state in which the four housings 16 are fitted to each other and the housing unit 4 is formed, the respective concave sections 25 of the adjacent housings 16 are linked, and an engaged section 26 is formed. The engaged section 26 is formed as a portion in which an engagement claw section 27 of the shield shell 5 which will be described later (refer to FIG. 1) is engaged.

As exemplified in FIG. 3, an abutting section 28 protrudes out of the bottom wall 18. As exemplified in FIG. 3, the abutting section 28 is disposed in the intermediate section outside the bottom wall 18. The abutting section 28 is formed in a rib shape which is convex to the outside. As exemplified in FIG. 3C, the abutting section 28 is formed in a linear shape, and is provided such that a length direction extends in the front and rear of the intermediate section on the outside of the bottom wall 18 along the axial direction of the housing 16.

In addition, as exemplified in FIGS. 3B and 3C, the fitting groove 24 is provided in the portion which links the bottom wall 18 and the right side wall 20. The fitting groove 24 is formed in a groove shape such that it is possible to fit the fitting protrusion 23. The fitting groove 24 is formed as a portion for positionally aligning the fitting position when the housings 16 are fitted to each other by fitting to the fitting protrusion 23. In the present Example, the fitting groove 24 is provided in three locations of the vicinity of a front end, a substantially intermediate section, and the vicinity of the rear end of the housing 16.

As exemplified in FIG. 3B, a positional alignment groove 30 is provided in the right side wall 20. As exemplified in FIG. 3B, the positional alignment groove 30 is formed in a linear shape, and is provided such that the length direction extends from the front end to the rear end of the housing 16 along the axial direction of the housing 16.

In addition, a concave section 25 is formed in a portion which links the bottom wall 18 and the front wall 21 on the right side wall 20. As exemplified in FIG. 1, in a state in which the four housings 16 are fitted to each other and the housing unit 4 is formed, the respective concave sections 25 of the adjacent housings 16 are linked, and the engaged section 26 is formed. The engaged section 26 is formed as a portion in which an engagement claw section 27 of the shield shell 5 which will be described later is engaged.

As exemplified in FIG. 2, a counterpart terminal insertion hole 31 is provided on the front wall 21. The counterpart terminal insertion hole 31 is formed through a circle shape, and is formed such that it is possible to insert the terminal (female terminal) of the connector (not shown in the drawings) which is a counterpart connector of the connector 1 (refer to FIG. 7). As exemplified in FIG. 2, the counterpart terminal insertion hole 31 is formed so as to link with the terminal accommodating section 29.

As exemplified in FIG. 2, the terminal insertion opening 19 is formed as an opening on the left side section of the housing 16. As exemplified in FIGS. 2 and 3A, the terminal insertion opening 19 is cut out in a rectangular shape, and is formed such that the length direction extends from the vicinity of the front end of the housing 16 to the rear end of the housing 16 along the axial direction of the housing 16. The terminal insertion opening 19 is formed such that the terminal 3 (refer to FIG. 4B) is insertable from a direction which is orthogonal to the axial direction of the housing 16. As exemplified in FIG. 2, the terminal insertion opening 19 is formed so as to link with the terminal accommodating section 29.

As exemplified in FIG. 2, the electric wire outlet 22 is formed as an opening on the rear end of the housing 16, and formed so as to be linked to the terminal insertion opening 19. The electric wire outlet 22 is provided as a portion in which the electric wire 6 leads out outside the housing 16 when the terminal 3 which is crimped onto terminals of the electric wire 6 is accommodated in the terminal accommodating section 29 of the housing 16. The electric wire outlet 22 is formed at a size at which it is possible to insert the electric wire 6. As exemplified in FIG. 2, the electric wire outlet 22 is formed so as to link with the terminal accommodating section 29.

As exemplified in FIG. 2, the terminal accommodating section 29 is formed as a portion in which the terminal 3 that is crimped onto the end of the electric wire 6 is accommodated inside the housing 16. As exemplified in FIGS. 2 and 3A, the terminal accommodating section 29 is provided such that the length direction extends from the vicinity at the front end to a rear end of the housing 16 along the axial direction of the housing 16. The terminal accommodating section 29 is formed in a shape such that it is possible to guide the terminal 3 (refer to FIG. 4B).

As exemplified in FIGS. 2 and 3A, a terminal holding section 32, a first terminal positional alignment section 33, and a second terminal positional alignment section 36 are formed in the intermediate section of the axial direction of the housing 16 in the terminal accommodating section 29.

As exemplified in FIG. 3A, the terminal holding section 32 is configured by a pair of engaging arms 34. The pair of engaging arms 34 are provided as a portion in which the terminal 3 (refer to FIG. 4B) is held so as to be embraced.

The pair of engaging arms 34 are integrally formed in the housing 16, and protrudes inside the right side wall 20 of the housing 16. As exemplified in FIG. 3A, the pair of engaging arms 34 protrude so as to face each other orthogonal to the axial direction of the housing 16. The pair of engaging arms 34 are formed in arm shapes which are bent in directions separated from each other. An engaging protrusion 35 is formed facing the inside of each other in respective free end sections of the pair of engaging arms 34.

As exemplified in FIG. 2 and FIG. 3A, the first terminal positional alignment section 33, and the second terminal positional alignment section 36 are disposed so as to interpose the terminal holding section 32 along the axial direction of the housing 16. As exemplified in FIG. 3A, the first terminal positional alignment section 33 and the second terminal positional alignment section 36 protrude respectively inside the upper wall 17, the bottom wall 18, and the right side wall 20 of the housing 16. The first terminal positional alignment section 33 and the second terminal positional alignment section 36 are formed in a rib shape which is convex to the inside.

Next, the shield shell 5 is described.

The shield shell 5 is formed in a shape as exemplified in FIG. 1 by sheet-metal working a metal plate which has conductivity. As exemplified in FIG. 1, the shield shell 5 is configured to be provided with a shield section 37, a pair of electric wire crimp sections 38, and a pair of insulation outer sheath crimp sections 39.

The shield section 37 is formed in box shape, and is provided with an upper wall 40, a bottom wall 41, a left wall 42, and a right wall 43, and a housing unit accommodating chamber 44 in which the housing unit 4 is inserted and accommodated is provided inside.

As exemplified in FIG. 1, the engagement claw section 27 is formed at the front end of each of the upper wall 40, the bottom wall 41, the left wall 42, and the right wall 43. The engagement claw section 27 is formed in a hook shape facing the inside of one of the sections. In addition, a positional alignment protrusion (not shown in the drawings) which is formed so as to be able to be engaged with the positional alignment groove 30 of the housing 16 is provided inside each of the upper wall 40, the bottom wall 41, the left wall 42, and the right wall 43.

The pair of electric wire crimp sections 38 are disposed behind the shield section 37, and are formed in the shape as exemplified in FIG. 1.

The pair of insulation outer sheath crimp sections 39 are disposed behind the pair of electric wire crimp sections 38, and is formed in the shape as exemplified in FIG. 1.

Next, a manufacturing method of the connector 1 is described below based on the configuration and structure described above.

The manufacturing method of the connector 1 consists of a manufacturing process of the housing 16 and a work process for assembling the connector 1.

The manufacturing process of the housing 16 is a process in which the housing 16 which has the configuration and structure described above is manufactured, and detailed description is omitted.

Next, the work procedure for assembling the connector 1 is described.

First, as exemplified in FIG. 4A, in the end section of the cable 2, the metal foil 7 and the insulation outer sheath 8 are peeled away, and the electric wire 6 is exposed. Then, intertwining of the plurality of electric wires 6 are unraveled.

Furthermore, in the respective terminals of the plurality of electric wires 6, the insulation sheath 10 is peeled away, and as exemplified in FIG. 4A, the conductor 9 is exposed. Thereafter, as exemplified in FIG. 4B, the semiconductor crimping section 11 of the terminal 3 is crimped by crimping each conductor 9.

Then, as exemplified in FIG. 5, each housing 16 is attached to the terminal 3 from a direction (in FIG. 5, a direction which is indicated by an arrow A) which is orthogonal to the axial direction of the housing 16. Thereby, the terminal 3 passes through the terminal insertion opening 19 from the direction which is orthogonal to the axial direction of the housing 16, and is inserted into the terminal accommodating section 29.

As exemplified in FIG. 5, when the terminal 3 is inserted into the terminal accommodating section 29, first, the small diameter section 14 of the linking section 13 of the terminal 3 abuts with an engaging protrusion 35 of the pair of engaging arms 34 which are exemplified in FIG. 3A. Then, when the terminal 3 is inserted as is, the pair of engaging arms 34 elastically deform, and the small diameter section 14 of the terminal 3 is inserted between the pair of engaging arms 34. Thereby, as exemplified in FIG. 6, the terminal 3 is held so as to be embraced by the terminal holding section 32.

In addition, the electrical connection section 12 of the terminal 3 abuts with the first terminal positional alignment section 33 (refer to FIG. 3A), since the large diameter section 15 of the terminal 3 abuts with the second terminal positional alignment section 36 (refer to FIG. 3A), movement of the terminal 3 is regulated in the axial direction of the housing 16.

Thereafter, four housings 16 in which the terminal 3 is accommodated are disposed in a state so as to be rotated 90° at a time, and the fitting protrusion 23 of the housing 16 is fitted in the fitting groove 24 of adjacent housings 16. A fitting position of each of the housings 16 are positionally aligned due to the fitting of the fitting protrusion 23 and the fitting groove 24. Thereby, four housings 16 are fitted, and the housing unit 4 which is exemplified in FIGS. 1 and 6 is formed.

As exemplified in FIG. 1, when the four housings 16 are fitted, the respective concave sections 25 of the adjacent housings 16 are linked. Thereby, the engaged section 26 is formed.

In addition, as exemplified in FIG. 6, when the four housings 16 are fitted, the abutting section 28 of the housing 16 enters the terminal accommodating section 29 of the adjacent housings 16, and the electrical connection section 12 of the accommodated terminal 3 abuts with the outer surface of the large diameter section 15. Thereby, the terminal 3 is pressed down in the abutting section 28 in a state of being accommodated in the terminal accommodating section 29.

Furthermore, the terminal 3 to which the housing 16 is attached is aligned in the manner exemplified in FIG. 6 by fitting the four housings 16. Thereby, change of shape of the terminal 3 is prevented.

Next, the housing unit 4 and the shield shell 5 are attached.

First, the housing unit 4 is inserted and accommodated in the housing unit accommodating chamber 44 of the shield section 37 from a direction which is indicated by arrow B which is exemplified in FIG. 1.

When the housing unit 4 is accommodated in the housing unit accommodating chamber 44, the positional alignment protrusion (not shown in the drawings) which is provided inside each of the upper wall 40, the bottom wall 41, the left wall 42, and the right wall 43 of the shield section 37 engages in the positional alignment groove 30 of each housing 16. Thereby, in the housing unit accommodating chamber 44, the housing unit 4 is positionally aligned. In addition, when the housing unit 4 is accommodated in the housing unit accommodating chamber 44, the engagement claw section 27 of the shield section 37 engages with the engaged section 26 of the housing unit 4 (refer to FIG. 7). Thereby, in the housing unit accommodating chamber 44, the housing unit 4 is more reliably positionally aligned.

Thereafter, the electric wire 6 is crimped and fixed by fastening the electric wire crimp sections 38 (refer to FIG. 7). Furthermore, the insulation outer sheath 8 of the cable 2 is crimped and fixed by fastening the insulation outer sheath crimp sections 39 (refer to FIG. 7). Thereby, as exemplified in FIG. 7, the shield shell 5 is attached to the housing unit 4.

As described above, work for assembling the connector 1 ends.

As described with reference to FIGS. 1 to 7, according to the present invention, it is possible to achieve matching of impedance between respective terminals 3 by forming at least one out of each divided housing 16 by a material which has a dielectric constant at which impedance between respective terminals 3 is a desired impedance. That is, merely by changing the material of at least one housing 16 out of each housing 16, it is possible to match impedance between respective terminals 3 to a desired impedance. Thereby, even in a case where the shape of the connector is determined according to the type or application of the connector, and the interval between the terminals 3 is confirmed, it is not necessary to change the material of the entire housing. For this reason, selection of the housing material becomes easy.

Accordingly, an effect is exhibited in which it is possible to easily perform matching of impedance between terminals while suppressing manufacturing costs of the connector.

In addition, according to the present invention, since the terminals 3 are respectively attached in the housing 16 which is divided in accordance with the number of terminals, it is possible to guide and accommodate the terminal 3 which is crimped onto respective terminals of the plurality of electric wires 6 to an appropriate position within the housing 16. Thereby, even in a case where the length of the plurality of electric wires 6 of which the intertwining is unraveled is short, it is possible to easily accommodate the plurality of terminals 3 in the housing 16. Thereby, work such that the terminals and the electric wires are aligned, that is necessary in the manner of the technique in the related art, is not necessary, and all of the individual terminals are collectively inserted into the terminal accommodating chamber of the housing.

Accordingly, an effect is exhibited in which it is possible to improve workability of attachment of the terminals in the housing.

In addition, according to the present invention, the terminals 3 are inserted and accommodated in the terminal accommodating section 29 from a direction orthogonal to the axial direction of the housing 16. Thereby, it is possible to accommodate each terminal 3 in the housing 16 one at a time. Thereby, even in a case where the length of the plurality of electric wires 6 of which the intertwining is unraveled is short, it is possible to easily accommodate the plurality of terminals 3 in the housing 16. Thereby, in the manner of the technique in the related art, work is not necessary such that the terminals and the electric wires are aligned, and all of the individual terminals are collectively inserted into the terminal accommodating chamber of the housing.

Accordingly, an effect is exhibited in which it is possible to improve workability of attachment of the terminals in the housing.

In addition, according to the present invention, it is possible to hold the terminals 3 in the housing 16 merely by mounting the terminals 3 in the terminal holding section 32.

Accordingly, an effect is exhibited in which it is possible to easily perform attachment work of the terminals 3 with respect to the housing 16.

In addition, according to the present invention, since the terminals 3 are held so as to be embraced in the terminal holding section 32, an effect is exhibited in which it is possible to reliably hold a state in which each terminal 3 is attached in the housing 16.

Furthermore, according to the present invention, it is possible to fix the terminals 3 at an appropriate position within the housing 16 by pressing down on the abutting section 28 in a state in which the terminals 3 are accommodated in the housing 16.

Accordingly, an effect is exhibited in which it is possible to more reliably hold the state in which each terminal 3 is attached in the housing 16.

Example 2

Example 2 is described with reference to FIG. 8.

Figure 8:
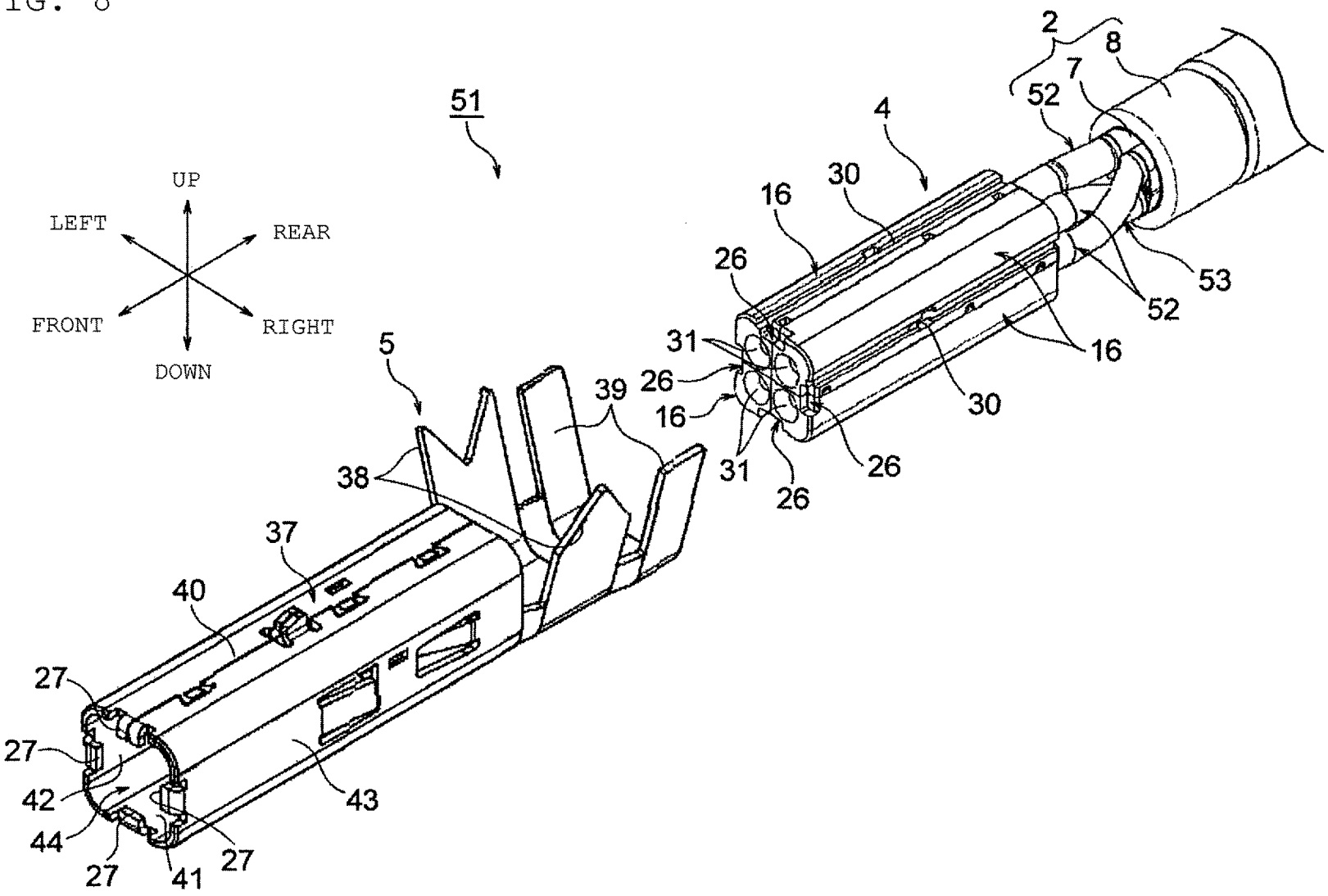
FIG. 8 is an exploded perspective view illustrating Example 2 of a connector of the present invention.
Figure 9:
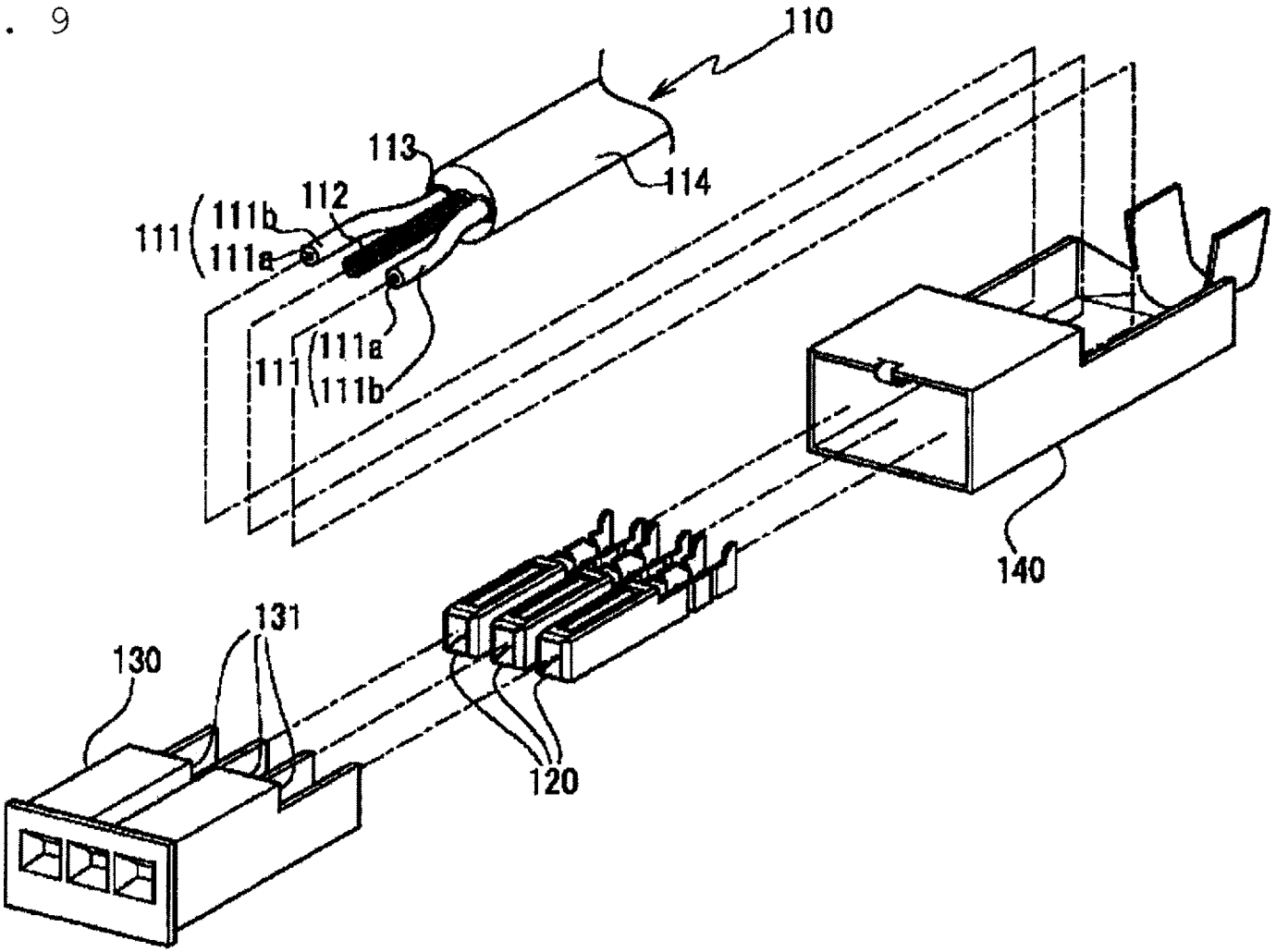
FIG. 9 is an exploded perspective view of the related art.

FIG. 8 is an exploded perspective view illustrating Example 2 of the connector of the present invention.

Here, arrows in the drawings indicate each direction of front and rear, up and down, and left and right (each direction of the arrows is an example).

In FIG. 8, reference numeral 51 indicates Example 2 of the connector of the present invention.

In the connector 51 in the present Example, another configuration of the exposed electric wire 52 in the end section of the cable 2 is provided with the same configuration and structure as Example 1. Accordingly, in the present Example, only the configuration of the electric wire 52 is described.

In the present Example, out of the plurality of electric wires 52 in which the exposed intertwining is unraveled in the end section, the cable 2 is provided with a configuration in which a twist section 53 is formed by intertwining at least one pair of electric wires 52. In the present Example, as exemplified in FIG. 8, out of the four electric wires 52, two electric wires 52 are intertwined one time and the twist section 53 is formed. The two intertwined electric wires 52 have a structure in the manner of a so-called twisted pair electric wire.

The number of times the electric wires 52 are intertwined is not limited to one time. That is, one pair of electric wires 52 may be intertwined two or more times.

In addition, in the present Example, out of the four electric wires 52, the two electric wires 52 are intertwined and the twist section 53 is formed, but is not limited thereto, and may have a configuration in which the remaining two electric wires 52 are intertwined and the twist section 53 is formed.

According to such a configuration, as will be described later, in the end section of the cable 2, transmission performance is improved in a portion in which the electric wire 52 is exposed (portion which is indicated by the reference numerals 52 and 53 which are exemplified in FIG. 8).

Here, the actions of the connector 51 according to the present Example will be described.

According to the connector 51 according to the present Example, a line of magnetic force which is generated in a pair of electric wires 52 that are intertwined acts in directions offset from each other by the electric wire 52 being intertwined two at a time, and configuring in the manner of the twisted pair electric wire. Thereby, in the one pair of intertwined electric wires 52, induced electromotive force which is generated due to electromagnetic induction cancel each other out. Thereby, out of the plurality of electric wires 52, electromagnetic noise is reduced due to the electromagnetic induction in comparison to a case where the plurality of electric wires are lined up substantially parallel by intertwining one pair of electric wires 52.

As it is possible to explain with reference to FIG. 8, according to the connector of the present invention, an effect is exhibited below other than exhibiting the same effect as the Example 1.

That is, according to the present invention, one pair of intertwined electric wires 52 in the end section of the cable 2 tends not to receive influence of electromagnetic noise due to electromagnetic induction in comparison to a case in which a plurality of electric wires are lined up substantially parallel to each other. Thereby, it is possible to match impedance in a portion in which the intertwining of the plurality of electric wires 52 is unraveled. Accordingly, in an end section of the cable 2, an effect is exhibited in which it is possible to reduce deterioration of transmission performance in a portion in which the electric wires 52 are exposed.

In addition, of course the present invention is able to implement various modifications in a range not altering the spirit of the present invention.

In the explanation of Examples 1 and 2, the connectors 1 and 52 are female connectors, but are not limited thereto, and the present invention may be applied to a male connector.

What is claimed is:

1. A connector comprising a housing unit which accommodates a plurality of terminals which are crimped onto respective ends of a plurality of electric wires, wherein the housing unit comprises a plurality of housings of a number corresponding to a number of the terminals, each of the housings configured to accommodate a respective one of the terminals, at least one of the housings is formed by a material that is different from a material from which another one of the housings is formed, the material of the at least one housing has a dielectric constant at which impedance between each of the terminals is a desired impedance, each of the housings includes an upper wall, a bottom wall, a right side wall and a terminal insertion opening, the right side wall extends from the upper wall to the bottom wall, the terminal insertion opening extends in an axial direction of the housings from the upper wall to the bottom wall and opposed to the right side wall, and each of the housings are connected to a respective different one of the housings such that the bottom wall of each of the housings extends across and covers the terminal insertion opening of the respective different one of the housings.

2. The connector according to claim 1, wherein an abutting section which abuts with a terminal of the terminals when the housings are fitted with each other is provided in each of the housings.

3. The connector according to claim 1, wherein each of the housings further includes:

a front wall at a first end of the housing that is connected to each of the upper wall, the bottom wall, and the right side wall, a terminal insertion hole extending through the front wall, and an electric wire outlet formed at a second end of the housing that is opposite to the first end, the electric wire outlet bounded by an end of each of the upper wall, the bottom wall and the right side wall, and wherein the terminal insertion opening extends from the front wall to the electric wire outlet.

4. The connector according to claim 1, wherein a terminal accommodating section with a concave shape along the axial direction of each of the housings is provided in each of the housings.

5. The connector according to claim 4, wherein a terminal holding section which holds a terminal of the terminals to be embraced is formed in the terminal accommodating section.

6. A manufacturing method of a connector comprising a housing unit which accommodates a plurality of terminals which are crimped onto respective ends of a plurality of electric wires, the housing unit comprising a plurality of housings of a number corresponding to a number of the terminals, the method comprising:

forming each of the housings with an upper wall, a bottom wall, a right side wall and a terminal insertion opening, the right side wall extends from the upper wall to the bottom wall, the terminal insertion opening extends in an axial direction of the housings from the upper wall to the bottom wall and opposed to the right side wall, forming at least one of the housings by a material that is different from a material from which another one of the housings is formed, the material of the at least one housing has a dielectric constant at which impedance between each of the terminals is a desired impedance, connecting each of the housings to a respective different one of the housings such that the bottom wall of each of the housings extends across and covers the terminal insertion opening of the respective different one of the housings.

7. The manufacturing method of a connector according to claim 6, further comprising:

unraveling intertwining of the ends of the plurality of electric wires which are provided with a configuration of intertwining the electric wires with each other, and crimping each of the terminals onto each of the ends of each of the electric wires; and after the crimping, intertwining at least one pair of electric wires out of the plurality of electric wires once or twice or more in respective ends of the plurality of electric wires.

8. The manufacturing method of a connector according to claim 6, wherein connecting each of the housings to a respective different one of the housings includes:

rotating each of the housings ninety degrees relative to the respective different one of the housings, and abutting the bottom wall of the respective different one of the housings with an edge of each of the upper wall and the bottom wall.

* * * * *